United States Patent [19]

Kobler

[11] Patent Number: 4,713,021

[45] Date of Patent: Dec. 15, 1987

[54] SEALED ELECTRICAL CONNECTOR AND METHOD OF USING SAME

[75] Inventor: Robert J. Kobler, Harrisburg, Pa.

[73] Assignee: AMP Incorporated, Harrisburg, Pa.

[21] Appl. No.: 735,416

[22] Filed: May 17, 1985

[51] Int. Cl.[4] ..... H01R 13/52

[52] U.S. Cl. ..... 439/272; 439/275; 439/589; 439/599; 439/712

[58] Field of Search ..... 339/91 R, 60 C, 60 R, 339/60 M, 94 R, 94 M, 94 C, 103 R, 103 M, 59 R, 59 M, 61 R, 61 M, 176 MP, 176 MF, 196 M

[56] References Cited

U.S. PATENT DOCUMENTS

| | | | |
|---|---|---|---|
| 2,731,610 | 1/1956 | Thacker | 339/89 |
| 2,881,406 | 4/1959 | Arson | 339/94 M |
| 2,896,186 | 7/1959 | Hardmark | 339/100 |
| 2,963,536 | 12/1960 | Kokalas | 174/77 |
| 2,984,811 | 5/1961 | Hennessey, Jr. | 339/94 M |
| 3,484,736 | 12/1969 | Wyse | 339/61 M |
| 3,576,517 | 4/1971 | Johnson et al. | 339/94 |
| 4,114,974 | 9/1978 | Lawrence | 339/60 C |
| 4,150,866 | 4/1979 | Snyder, Jr. et al. | 339/94 M |
| 4,193,655 | 3/1980 | Herrmann, Jr. | 339/59 M |
| 4,310,211 | 1/1982 | Bunnell et al. | 339/91 R |
| 4,486,062 | 12/1984 | Kasugai | 339/91 R |
| 4,519,133 | 5/1985 | Pansanel | 339/176 MF |

FOREIGN PATENT DOCUMENTS 724596 2/1955 United Kingdom .

*Primary Examiner*—Gil Weidenfeld
*Assistant Examiner*—David Pirlot
*Attorney, Agent, or Firm*—Anton P. Ness

[57] ABSTRACT

A sealed electrical connector has a housing receiving terminated conductors therein, for mating to a corresponding connector. A camming member is latched to the rear of the housing with bores therethrough through which the conductors extend. Wire seals are disposed between the housing and the camming member around each conductor. A sequential latching provides a first or open position for the camming member which allows for insertion of the terminated conductors through bores of the camming member, through respective wire seals and into respective passageways of the housing wherein the terminals are seated. The camming member is then moved axially forward to a second or closed position which cams against the rear sections of the wire seals and urges and deforms them radially inwardly against the conductors so that a pressure-resistant seal is formed between the conductor, the wire seal, and the camming member. Several types of wire seals are usable with the sealed connector. A latching system for sequential latching of the housing member and camming member has two axially spaced projections on the housing which latch into a slot behind a collar in a first latching and a second latching upon urging the housing and camming members together.

17 Claims, 10 Drawing Figures

SEALED ELECTRICAL CONNECTOR AND METHOD OF USING SAME

FIELD OF THE INVENTION

This relates to electrical connectors and more particularly to sealed electrical connectors.

BACKGROUND OF THE INVENTION

Electrical connector assemblies are known which have interfacial seals to sealingly engage a mating connector. Connectors are also known which provide an environmental sealing arrangement between the connector body and the insulated cables of the individual terminated conductors securely retained therein. For instance, U.S. Pat. No. 4,150,866 discloses a connector having a dielectric body with a plurality of contact-receiving cavities therein. A like plurality of insulated conductor wires with terminals thereon is inserted through individual elastomeric seals, and with the contacts secured in the forward ends of the cavities the seals sealingly grip the respective insulated coverings of the conductors and also sealingly engage sidewalls of the cavities at the rear of the connector body. With the particular shape of the seals, the seals are said to allow easy replacement of the contacts and to provide a wiping action between both the seal and connector and the seal and conductor to assure removal of any dirt or debris at the rear of the connector during removal of the contact, keeping the cavity clean. It is also common practice to insert unterminated conductors through the wire seals, followed by terminating the terminal to the conductor end, avoiding the risk of the terminal tearing the seal during insertion.

It is known to use a sealing grommet at a rearward end of a connector to seal against wires extending through holes thereof, such as is disclosed in U.S. Pat. No. 4,241,967. The grommet therein is described as having a plurality of resilient webs extending radially inwardly in each hole thereof to engage against the wires for sealing, and a single grommet is said to provide for use of wires of varying diameters by having webs of different inward extension. It is also known from U.S. Pat. No. 2,383,926 to use a (relatively) incompressible, elastomeric transverse gland or sealing member within a connector to securely retain contact terminals extending through holes thereof, by deforming into annular recesses of the terminals when the gland is placed under pressure by urging together forward and rearward transverse plates thereagainst by clamping means, after terminals on ends of conductors are inserted thereinto. The gland is said to provide fluid-tight sealing.

Sealed connector assemblies find especial application where electrical connectors are exposed to adverse environmental conditions either during performance or during servicing and repair of the connector or both. Adverse environmental conditions could include incidental water spray, high-nozzle-velocity water spray or steam such as during periodic cleaning, high humidity, and dust or debris. Typical uses for such a sealed connector would be in an electrical system for an agricultural tractor (where spray cleaning, dust and weather are involved) or air conditioner ducts (where high humidity is involved). It is foreseeable that such a connector assembly would need to be serviceable in the field in that one of the contacts may need to be replaced in the connector. It is also foreseeable that an entire assembly may need to be applied to conductors in the field and therefore should require as few steps as possible in as simple and quick and effective a procedure as possible.

Such an assembly should also preferably provide strain relief to protect the terminals from being damaged or accidentally dislodged from their cavities or from electrical engagement with mating contacts. Such strain relief should also protect against lateral stress of the conductors, that is by the conductors being urged to the side, near the connector, as well as against longitudinal or tensile stress, that is by the conductors being pulled away from the connector assembly.

Such an assembly should have seals which do not provide inhibiting levels of resistance to the insertion of terminated conductors therethrough. Such an assembly should have seals which resist damage when a terminated conductor is being inserted therethrough, such as that which could arise because a terminal may have laterally projecting portions and corners which would tend to tear an elastomeric seal. This tendency would be greater for seals whose surface portions have substantial coefficients of friction.

SUMMARY OF THE INVENTION

The present invention provides a sealed electrical connector assembly which has a connector housing with terminal-receiving cavities therein, a wire seal in each cavity at the rearward end of the connector housing, and a camming member having bores through a transverse section thereof corresponding to the terminal-receiving cavities of the housing. The wire seals have rear or strain relief sections extending rearwardly from the housing when in place in the respective cavities, and the camming member is positionable in a first position on the rearward end of the housing such that the rear sections of the wire seals extend through the respective bores in the transverse section of the camming member. Conductors having terminals terminated to the conductive cores thereof are insertable into the rear sections of respective wire seals, and are urged forwardly until the terminals thereon pass entirely through the wire seals and into forward sections of the terminal-receiving cavities of the housing where they are secured in a conventional manner such as by rearwardly extending latching lances of the terminals engaging forwardly facing stop shoulders of the cavities.

When all terminated conductors have been inserted and their terminals secured in the cavities, the camming member is now moved forwardly to a second final position with respect to the housing. Surface portions of the bores of the camming member engage raised annular surfaces of the wire seals and urge the raised wire seal surfaces radially inwardly, deforming the rear section of the wire seal against the insulated covering of the conductor to provide sealing and firm mechanical gripping engagement. Such engagement provides an effective strain relief of the connector assembly with the conductors at a location spaced rearwardly from the terminals and from the sealing of the wire seals with the cavities of the connector housing. The profile of the wire seal may cooperate wtih a specially designed internal space between the connector housing and the caming member to allow for deformation of the wire seal thereinto, for use with larger diameter conductors which allow little radially inward deformation of the wire seal by the camming member.

The camming member provides a physical barrier against spray and debris. The sealing engagement of the wire seals with both the conductor and the camming member provides a first sealing effective against pressurized spray as well as incidental spray and dust and debris, as well as a strain relief. The sealing engagement with the housing and the conductor, in combination with the first sealing, provides a second sealing effective against humidity and steam. The sealed connector of the present invention thus provides a dual seal and a strain relief, and does so without necessarily tightly engaging a terminated conductor being inserted therethrough at least at the rear of the wire seal. The camming member of the present invention also permits the use of certain wire seals which do not themselves engage the conductor extending therethrough until deformed radially inwardly by the camming member.

The present invention also provides a sequential latching system for establishing a first or open position of the camming member with respect to the housing whereat the wire seals are not deformed inwardly, so that conductors can be inserted into the assembly, and for achieving a second or closed position to deform the wire seals against the conductors. This is accomplished by axially spaced first and second projections on the housing which sequentially latch into a slot behind a collar of the collet section of the camming member as the housing and cam are urged together.

DETAILED DESCRIPTION OF THE PREFERRFED EMBODIMENT

Figure 1:
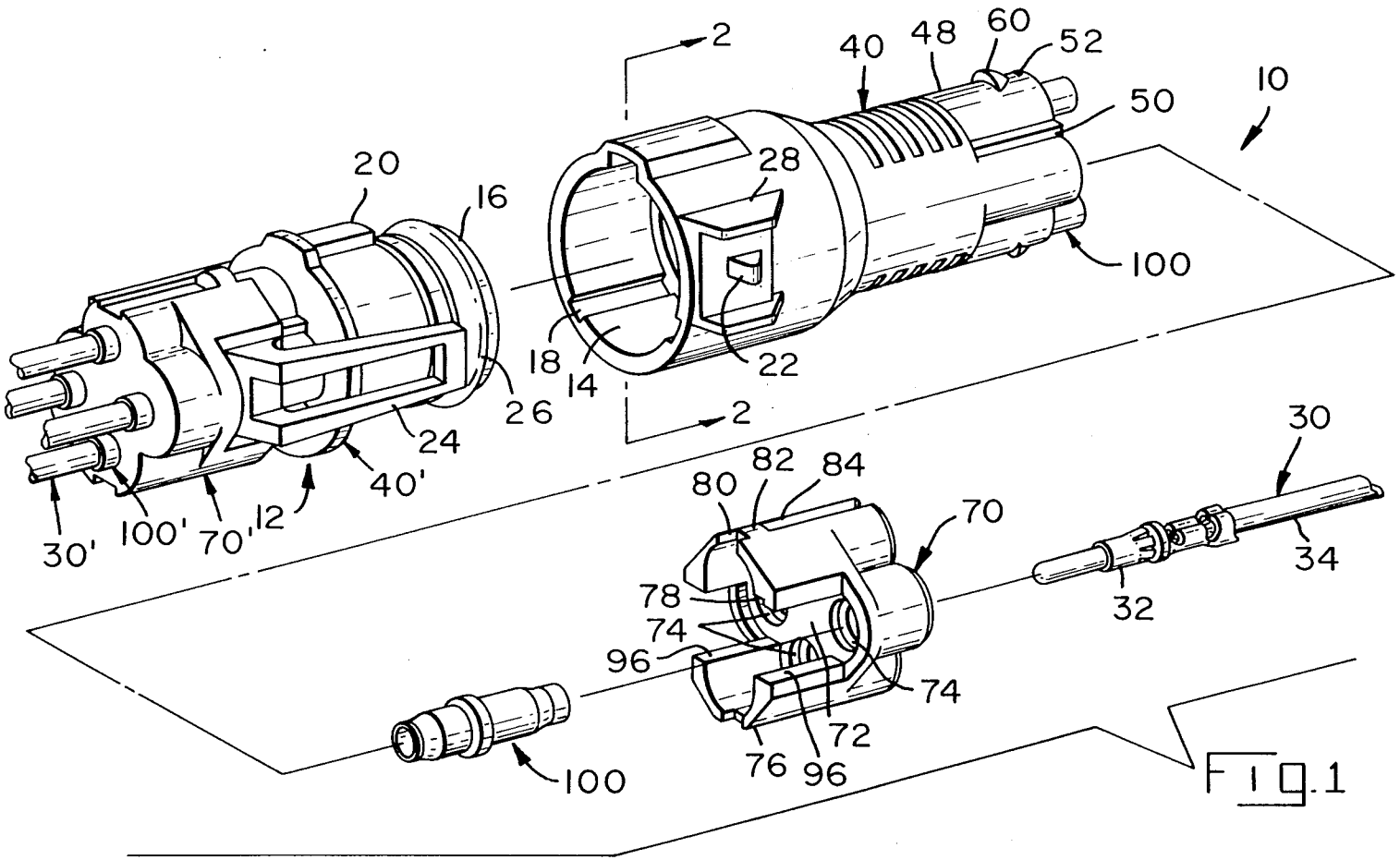
FIG. 1 is a perspective view of a mating pair of sealed connector assemblies with a camming member of one exploded therefrom.

FIG. 1 illustrates a mating pair of sealed connectors 10, 12 of the present invention for a plurality of conductors 30' extending from connector 12 and terminated conductors 30 exploded from connector 10. Camming means such as camming member 70 is exploded from housing means such as housing 40 of connector 10. Connector 12 includes an identical camming member 70' shown assembled onto housing 40'. Housing 40 and camming member 70 are of relatively rigid, resilient, dielectric material such as a thermoplastic resin and are preferred to be made of unfilled thermoplastic polyester such as VALOX 357 resin (trademark of General Electric Company). Camming member 70 could optionally be metallic. Wire seals 100, 100' extend rearwardly from housings 40, 40' and are preferably made of relatively incompressible elastomeric material such as epichlorohydrin elastomers or an elastomer of chloroprene such as neoprene which have added thereon a surface coating of compatible lubricating fluid such as petroleum jelly, or a compatible mold release composition. Most preferably, wire seals 100 are molded of a novel neoprene composition set forth in U.S. patent application Ser. No. 735,418 filed May 17, 1985, wherein a lubricating material is molded into the wire seal, providing inherent lubricity.

Connector 10 can be of the receptacle type having a large forward cavity 14 to receive a plug section 16 of a plug type connector 12 therein. Cavity 14 may have keying channels 18 therealong to receive keying projections 20 along plug section 16. A beveled latching projection 22 may extend outwardly from housing 40 to latchingly engage a latching arm 24 of housing 40' of connector 12 to secure connectors 10, 12 together. Latching projection 22 is protected by a pair of circumferentially spaced axial ribs 28, one on either side thereof. Preferably, a latching means is used herewith as is set forth in U.S. patent application Ser. No. 735,417 filed May 17, 1985, which provides a substantial initial resistance to latching above the internal resistive forces generated by the mating contacts (and the deforming of an annular seal), but provides a sudden relief from latching resistance when the latch arm latches over the abrupt projection, providing a snapping which audibly and tactilely indicates full mating. Plug connector 12 may preferably have a sealing means such as an O-ring 26 seated in a circumferential groove therearound to seal circumferentially within large cavity 14. Preferably, a novel annular seal is used as is disclosed in U.S. patent application Ser. No. 735,889 filed May 17, 1985. Conventional pin and socket terminals (not shown) may be used to terminate respective conductors 30, 30' which electrically engage when connectors 10, 12 are mated, which terminals should be compatible with insertion through a wire seal.

Figure 2:
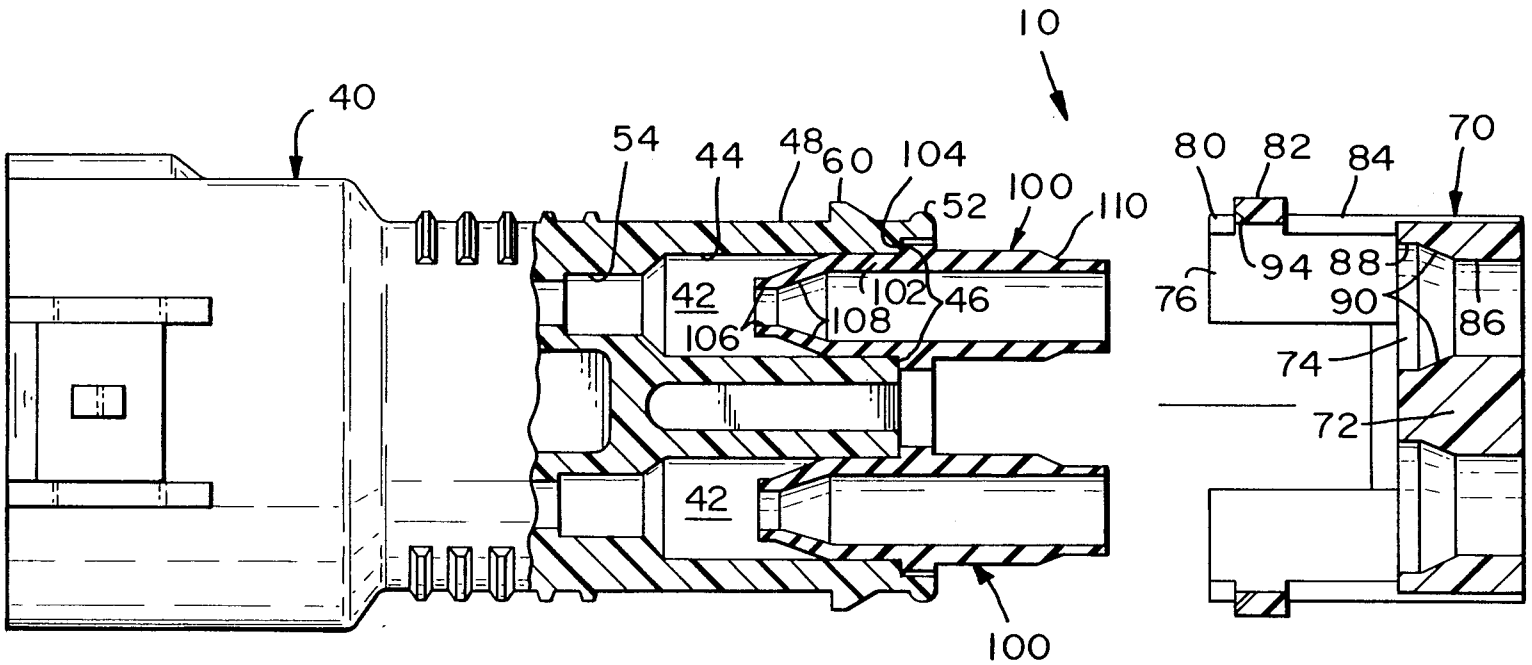
FIG. 2 is a part longitudial section view of the sealed connector of FIG. 1 with a first embodiment of wire seal positioned in the housing, and the camming member exploded therefrom.

In FIG. 2, camming member 70 is shown exploded rearwardly from housing 40, and wire seals 100 have been placed in rearward or seal-receiving sections 44 of terminal-receivig cavities 42 of housing 40. It is preferred that wire seals 100 have connector-engaging sections 102 which are of a slightly larger diameter than the inside diameter of rearward cavity sections 44, and that wire seals 100 are in interference fit with cavity sections 44 for a preselected distance providing a sealing engagement with the conector, as taught in U.S. Pat. No. 4,150,866. Wire seals 100 also preferably have annular stop shoulders 104 which engage a stop means 46 on the rear surface of housing 40 around respective cavities 42 to stop forward movement of wire seals 100 when inserted thereinto and also later when conductors are inserted thereinto as is described below. It is also preferred, but not essential to the present invention, that wire seals 100 have forward conductor-engagig sections 106 spaced forwardly from connector-engaging sections 102, with frustoconical sections 108 connecting sections 102 and 106, which sections 106 tend to center and hold the conductors in cavities 42 after insertion thereinto as well as sealingly engage the conductors. Conventional practice to facilitate insertion of terminals through tight wire seal portions calls for applying alcohol to the terminals for lubrication to reduce the likelihood of tearing the seal, and afterward the alcohol evaporates. It is preferred for the present invention to use a wire seal having inherent lubricity to facilitate terminal insertion, such as is disclosed in U.S. patent application Ser. No. 735,418.

Figure 3A:
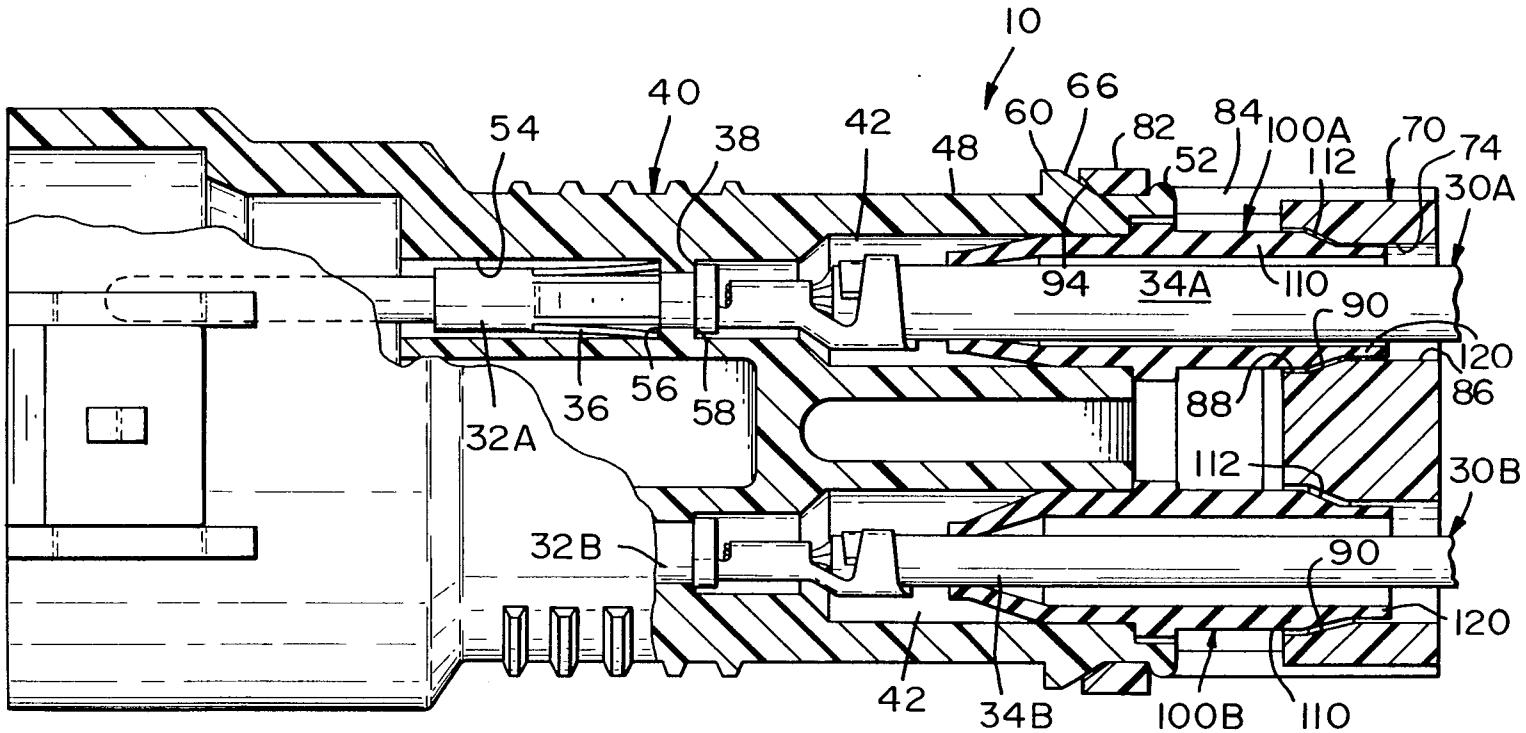
FIGS. 3A and 3B are part longitudinal section views of the assembly of FIG. 2, with large and small size conductors inserted thereinto, the camming member in first and second positions respectively, and a terminal shown secured in a cavity.

Camming member 70 has a transverse section 72 having profiled bores 74 therethrough corresponding to terminal-receiving cavities 42 of housing 40. Referring to FIGS. 1 and 2, extending forwardly from transverse section 72 preferably is a collet section 76 within which is received a rearward section 48 of housing 40, with a keying channel 78 receiving a keying ridge 50 of housing 40. Collet section 76 may be bifurcated, or it may optionally be a circumferentially continuous resilient hood profiled to fit rearward housing section 48 and have an O-ring or other means (not shown) for sealing with a connector housing. For practical purposes it is preferred that such a camming member 70 be used interchangeably with housing 40' of connector 12 having latching arms 24; therefore, large arm-receiving recesses 96 are disposed on opposing sides of camming member 70 and receive latching arms 24 as shown by camming member 70' in FIG. 1. When being assembled to rearward section 48 of housing 40 after wire seals 100 are in place in cavities 42 of housing 40, collet section 76 preferably has opposing recesses 80 to receive opposing first small rounded projections 52 on rearward section 48 therein which serves to indicate that camming member 70 is in axial alignment with respect to housing member 40. Beveled resilient collar sections 82 at rear ends of recesses 80 ride over small projections 52 (which may be rounded) as camming member 70 continues to be urged axially forwardly until small projections 52 are disposed in longitudinal slots 84, as best seen in FIG. 3A. Slots 84 may extend to the rearward end of camming member 70 to facilitate molding. With camming member 70 secured to housing 40 in this first or open position, terminated conductors are inserted into respective bores 74 and forwardly through rearward sections 110 of wire seals 100, and into cavities 42 where the terminals are secured in position.

In FIG. 3A, terminated conductors 30A, 30B are shown in place in terminal-receiving cavities 42 of housing 40, with conductor 30A having a relatively large diameter and conductor 30B having a relatively small diameter, which illustrates that the wire seals preferred for use with the present invention may be used with wire diameters of several different sizes if the differences are not substantial, thus reducing the number of different sized wire seals needed to be able to accommodate all relevant wire sizes. Terminals 32A, 32B are crimpingly secured to conductive cores of conductors 30A, 30B forwardly of insulated conductor portions 34A, 34B. Terminated conductors 30A, 30B are inserted into rearward sections 110 of wires seals 100A, 100B respectively and are urged forwardly through the wire seals and into forward sections 54 of terminal-receiving cavities 42. Terminal 32A is shown in FIG. 3A secured in forward section 54 of a respective cavity 42 in a conventional manner such as by rearwardly extending lances 36 thereof engaging a forwardly facing stop shoulder 56, and a forwardly facing stop shoulder 38 thereof engaging a rearwardly facing cavity stop surface 58. Thus a terminal is secured against forward and rearward axial movement when fully inserted, and insulated conductor portions 34A, 34B are disposed in wire seals 100A, 100B with camming member 70 in its first or open position.

Profiled bores 74 of camming member 70 have rear sections 86, forward sections 88 and intermediate sections therebetween which are preferably beveled or possibly slightly outwardly radiussed facing axially forwardly and radially inwardly which are termed camming surfaces 90 herein. Rear sections 86 have a diameter larger than a conductor portion 34A, 34B insertable therethrough. Forward sections 88 have a diameter larger than that of rear sections 86 and of rearward seal sections 110. When camming member 70 is in its first or open position, rearward seal sections are disposed in respective profiled bores 74 such that corresponding seal camming surfaces 112 are proximate camming surfaces 90 or even just in engagement therewith, and rearward ends 120 are within rear bore sections 86, allowing visual inspection to assure the presence of and the proper positioning and alignment of the wire seals. Camming member 70 also maintains wire seals 100 in position during insertion of conductors 30. Camming surfaces 90 are preferred to be at an angle of about 30 degrees from axial, and seal camming surfaces 112 correspondingly at the same angle from axle. Seal camming surfaces 112 are preferably substantially annular and beveled, and facing radially outwardly and axially rearwardly so as to cooperate with camming surfaces 90, as will be explained below.

Figure 3B:
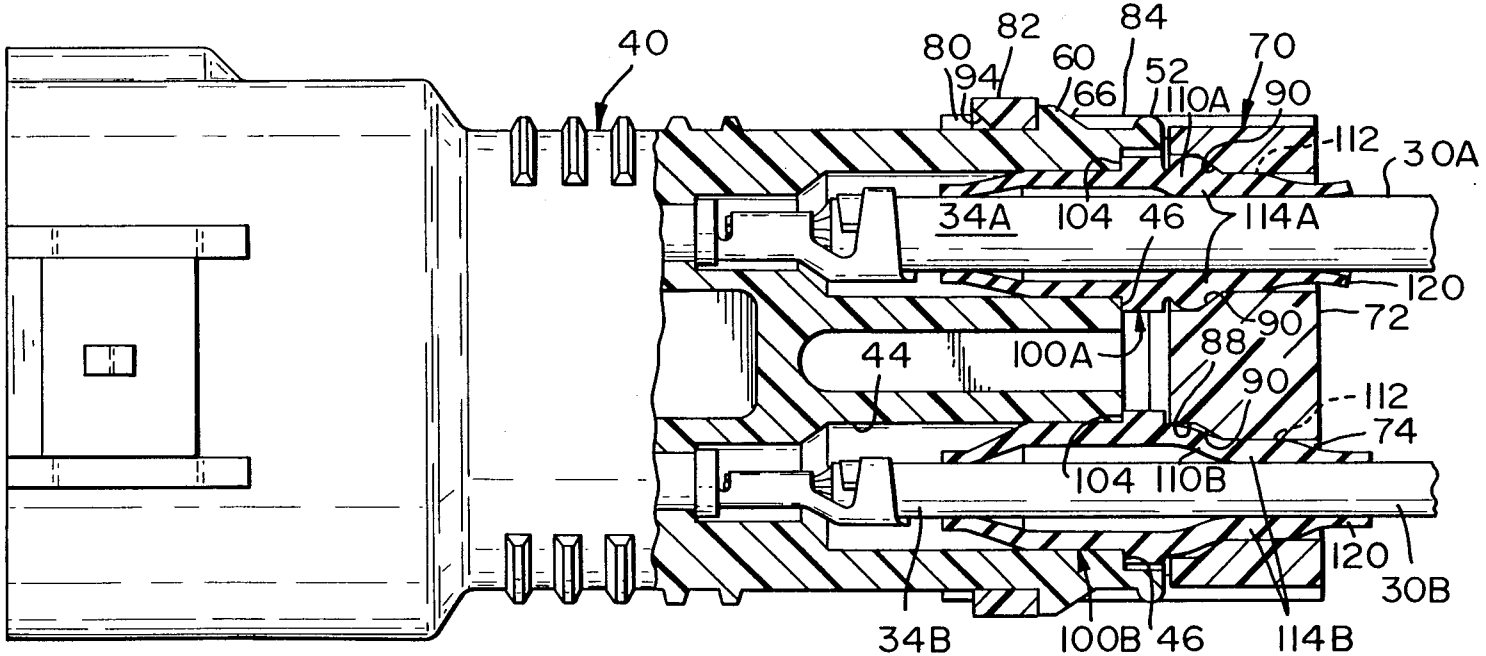

As is illustrated in FIG. 3B, camming member 70 is now moved axially forward to its second or closed position. In moving to this closed position, collar sections 82 ride over large second projections 60 spaced forwardly from first projections 52 and preferably having beveled surfaces 66 facing rearwardly and outwardly. Large beveled second projections 60 preferably have entered respective recesses 80 when first projections 52 enter longitudinal slots 84 as camming member 70 reaches the first or open position. Camming member 70 reaches its second or closed position when large projections 60 enter slots 84 and latch behind collar sections 82, with small first projections 52 also disposed in portions of slots 84 rearward from large projections 60. Collar sections 82 are preferred to have beveled surfaces 94 facing forwardly and inwardly. Use of a bifurcated collet section assists resilient collar sections 82 to ride over projections 52 by acting as a cantilever beam.

Simultaneously, camming surfaces 90 in the walls of bores 74 substantially engage corresponding seal camming surfaces 112 on outside surfaces of rearward sections 110 of wire seals 100A, 100B. Rearward seal sections 110 are deformably urged radially inwardly against insulated conductor portions 34A, 34B by the camming engagement thus described, because of annular seal stop shoulder 104 engaging stop means 46 on the rear surface of housing 40 which stops axially forward movement of seals 100A, 100B. It is preferred that there be lubrication fluid on at least the surface of seal camming surfaces 112 so that bore camming surfaces 90 can slide thereover. It is most preferred that the wire seals have inherent lubricity molded thereinto as disclosed in said U.S. patent application Ser. No. 735,418.

As illustrated in FIG. 3B, the reaction of wire seal 100B around smaller diameter conductor 30B is a relatively simple radially inward deformation 114B, with rearward section 110B sealingly engaging conductor 30B and extending somewhat therealong and possibly rearwardly from transverse section 72 of camming member 70. The reaction of wire seal 100A to larger diameter conductor 30A involves less radial deformation inwardly but substantial deformation 114A forwardly and radially outwardly. Forward sections 88 of proflied bores 74 have a large diameter to permit such outward deformation 114A. It is preferred that there be surface lubrication on the inside surfaces of wire seals 100A, 100B and most preferred that the wire seals have inherent lubricity molded thereinto, so that as the wire seals are deformed into engagement with conductors 30A, 30B, that portion of deformation 114A, 114B can move along conductor portions 34A, 34B a slight extent, especially to overcome high coefficients of friction of certain types of conductor insulation material.

It can be seen that radially inward sealing about the conductors 30A, 30B by the wire seals 100A, 100B is effected by axially forward movement of camming member 70 through engagement of its camming surfaces 90 with respective camming surfaces 112 (now shown in phantom) of wire seals 100A, 100B. Camming member 70 provides a physical barrier against much of the spray and the debris, and helps protect the sealing of the wire seals 100A, 100B with housing 40. Sealing engagement by wire seals 100A, 100B with camming member 70 provides significant protection against high-nozzle-velocity spray from rearwardly of the connector assembly, and against dust and debris and incidental spray. It can be seen that different but relatively adjacent wire sizes can be sealingly engaged by the same wire seal. Such sealing engagement as at 114A and 114B provides strain relief engagement with conductors 30A, 30B rearward from the terminals 32A, 32B and from the connector housing 40. It is believed that axially forward urging of wire seals 100 improved their sealing engagement with rearward sections 44 of cavities 42 of connector housing 40. Sealing of wire seals 100 with housing cavity sections 44 provides superb environmental sealing especially against humidity and, in cooperation with the barrier which camming member 70 comprises and the sealing of the wire seals at 114A, 114B, superb overall environmental sealing.

It is foreseeable that wire seals of different inner diameters can utilize the same outer diameter and same profile to accommodate different wire sizes and still be usable with the same camming member and housing without adversely affecting the desired deformation because of changed thickness of wire seals. It is also possible, of course, to modify the diameters of bores 74 and cavities 44 to accommodate wire seals of different outer diameter.

Figure 4A:
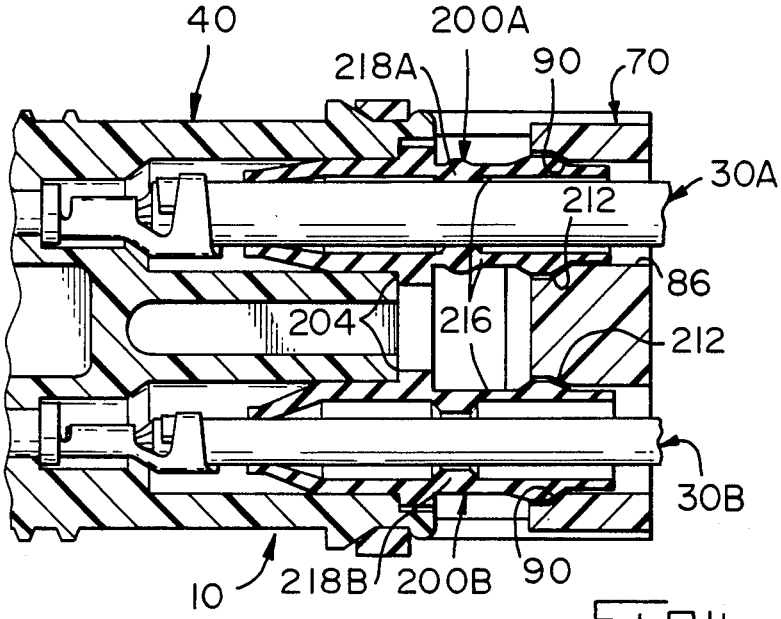
FIGS. 4A and 4B are similar to FIGS. 3A and 3B with a second embodiment of wire seal.
Figure 4B:
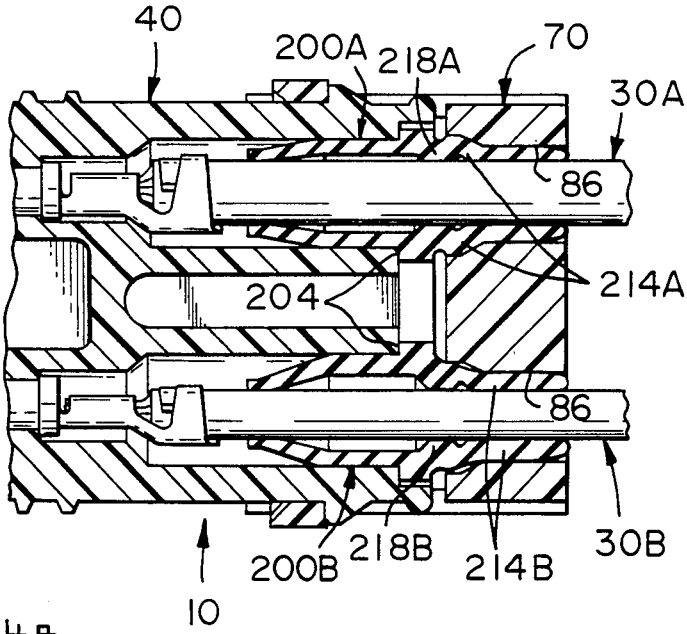

A second embodiment of wire seal is shown in FIGS. 4A and 4B with wire seals 200A, 200B receiving larger diameter conductor 30A and smaller diameter conductor 30B therethrough respectively. Wire seals 200A, 200B have reduced outer-diameter intermediate sections 216 between camming surfaces 212 and annular stop shoulders 204. An inner annular rib portion 218A, 218B extends radially inwardly from the intermediate section 216. Deformation at 214A, 214B is believed to more easily be controlled and stabilized by annular rib portion 218A, 218B to provide assured sealing against the conductor 30A, 30B by rib 218A, 218B and result in less rearward extrusion of the wire seal along rear bore section 86.

Figure 5:
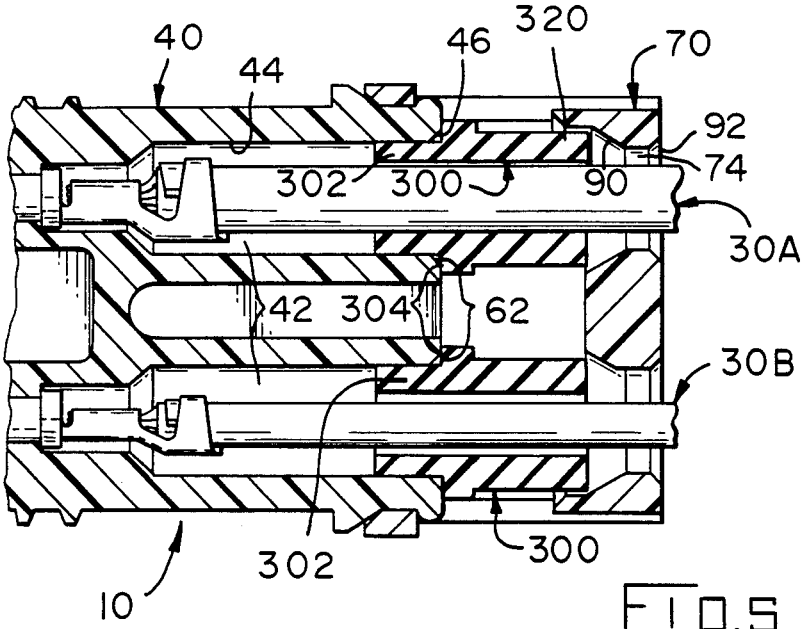
FIG. 5 is a part longitudinal section view of a third wire seal embodiment assembled within the housing and camming member.
Figure 6:
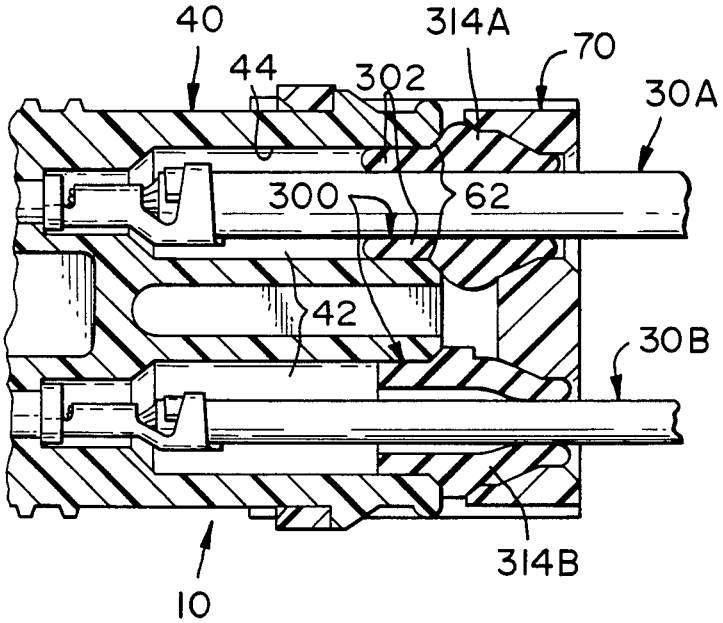
FIG. 6 shows the camming member acting with the wire seal of FIG. 5 around two different-sized conductors.

A third embodiment of wire seal is shown in FIGS. 5 and 6. Wire seal 300 has a shorter length and a simpler geometry, without a forward conductor-engaging section. Wire seal 300 is contained entirely within the housing/camming assembly 40, 70. Terminated conductors are insertable into bores 74 of member 70, preferably having lead-ins 92. Camming surfaces 90 engage the rearward sleeve-like end 320 of wire seal 300, which end 320 need not be correspondingly beveled, and radially deform rearward end 320 inwardly against conductors 30A, 30B as in FIG. 6, to result in a deformation 314A, 314B respectively. An effective sealing engagement with the conductor is thus obtained at this single location along the conductor, and an effective sealing engagement with the housing 40 is also obtained from the interference fit of forward seal section 302 within rearward cavity section 44 of housing 40 forwardly of annular stop shoulder 304. As shown in FIG. 6, rearward entrance 62 to terminal-receiving cavities 42 may be beveled or radiussed, and still result in effective sealing while facilitating insertion of wire seals 300 thereinto. Such an embodiment of wire seal 300, without a conductor-engaging section of reduced inner diameter in interference fit with the terminated conductor during and after insertion therethrough, minimizes the possibility of tearing the wire seal by such insertion; and therefore it is possible to use materials such as silicon rubber having lower tear strength and lower durometer.

Figure 7:
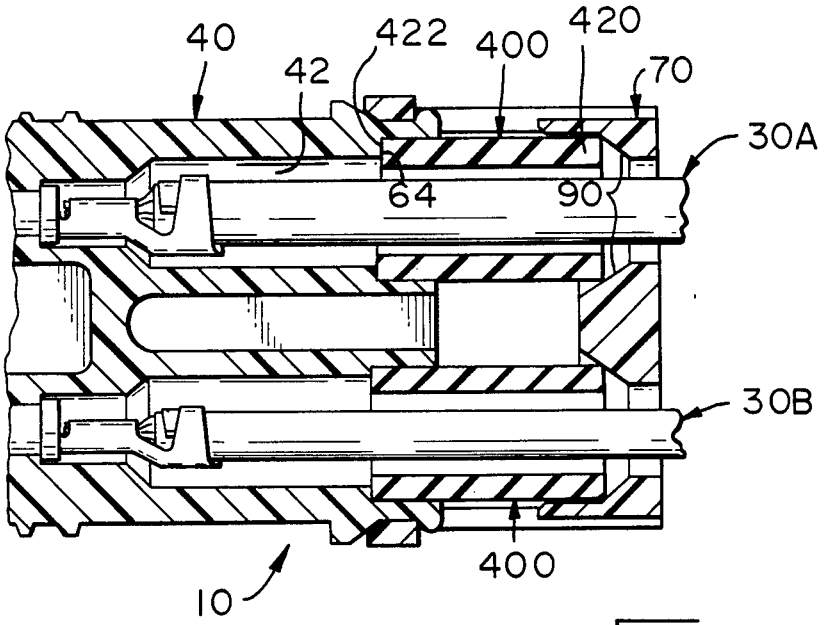
FIGS. 7 and 8 are similar to FIGS. 5 and 6 with a fourth type of wire seal.
Figure 8:
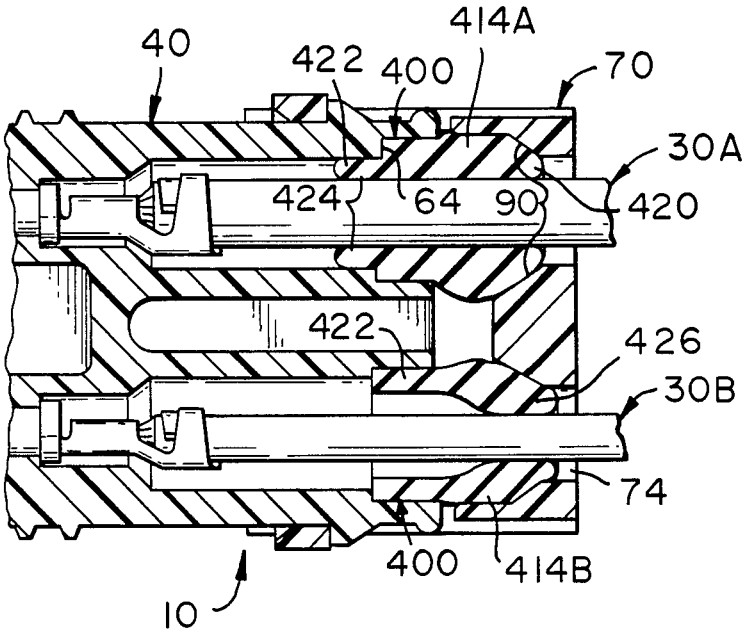

It is even possible, with the cooperation of the camming member 70 of the present invention, to use a simple sleeve shape for the wire seal, as illustrated in FIGS. 7 and 8. In FIG. 7, a forward end 422 of wire seal 400 engages a stop surface 64 of cavity 42 of housing 40 to seat seal 400 in cavity 42. After insertion of terminated conductors 30A, 30B therethrough, as shown in FIG. 8, camming member 70 is moved to its closed position, with camming surfaces 90 engaging rearward end 420 of seal 400 and radially deforming seal 400 inwardly against the conductor and then forwardly and outwardly as shown at 414A, or outwardly as shown at 414B. With larger diameter conductor 30A, forward end 422 of seal 400 could extrude forwardly of cavity stop surface 64 and deform inwardly as at 424 which serves to seal against the conductor. With smaller diameter conductor 30B, rearward end 420 of seal 400 could extrude rearwardly as at 426 into bore 74 of camming member 70, along conductor 30B, which serves to seal against the conductor. An effective sealing engagement is also obtained with connector housing 40 at 422.

With the camming member of the present invention, many embodiments of wire seals are usable therewith to provide effective sealing engagement between the seal and the conductor at least at the rear of the seal, between the seal and the connector, and between the seal and the camming member. Axially forward movement of the camming member from its first or open position to its second or closed position results in gripping and sealing by the seal of the conductor, and permits use of larger diameter seals which allow insertion of terminated conductors therethrough with minimal tearing tendencies and still result in tight sealing between the seal and the conductor at least at a rearward position which can also serve as an effective strain relief.

The present invention may be used with connectors having a rectangular shape or other shape as desired. It is believed that other embodiments, with variations and modifications, of connector housings and camming members may be devised by those skilled in the art, without departing from the scope of the claims and the spirit of the invention. The sequential latching system of the present invention is also capable of use with other types of connector members requiring first and second positions, or even more than two positions through the use of corresponding additional latching projection means; and other variations may occur such as additional slots and collars therebetween to receive and provide latching capability with the additional projections. Variations in the shape of the latching projections may occur to those skilled in the art which are usable in the latching system of the present invention.

What is claimed is:

1. A sealed connector assembly for receiving insertably thereinto and securing therewith electrical conductors having terminals terminated on ends thereof, comprising:

housing means, a rigid camming member secured to a rearward end of said housing means, and a plurality of individual wire seal members secured therebetween, defining a preassembled connector assembly prior to insertion of terminated conductors thereinto, wherein:

said housing means having a plurality of terminal-receiving cavities extending therethrough each to receive a respective terminated electrical conductor securely thereinto;

said plurality of individual wire seal members each associated with a said terminal-receiving cavity and said respective conductor, each said wire seal member being elongated and sleeve-like of relatively incompressible, deformable elastomeric material and having a conductor-receiving aperture extending therethrough for a said respective terminated conductor, each said wire seal member adapted to receive insertably therethrough a said terminated conductor and then initially loosely surround an insulated conductor portion therewithin substantially therealong, each said wire seal member having a forward seal portion disposed and held within a rearward section of a said associated terminal-receiving cavity and at least a rearward seal portion extending rearwardly from said cavity, said wire seal members held by said housing means prior to securing said camming member thereto;

said rigid camming member securable to said housing means in a first fixed position after said wire seal members are disposed within respective said terminal-receiving cavities of said housing means, said camming member exposing said rearward seal portions of said wire seal members for receiving said terminated ends of respective said conductors thereinto, said camming member being movable relatively towards said housing means from said first position to a second position; and each said wire seal member including a camming surface portion on a radially outward surface thereof at least proximate a rearward end thereof, and said camming member having respective rigid cooperating camming means associated with said camming surface portion of each said wire seal member, all such that when said camming member is in said first position, a said terminated end of each said conductor is insertable into and through an associated said wire seal member and the terminal terminated to said conductor is securable in said associated terminal-receiving cavity, and when said camming member is moved to said second position, said camming surface portion of each said wire seal member is engaged by a said associated rigid cooperating camming means of said camming member and placed under force directed substantially radially inwardly, and the rearward section of each said wire seal member is radially deformed thereby into sealing engagement around an insulated portion of a said respective conductor, whereby said camming member cams the plurality of said wire seal members simultaneously into sealing engagement with respective said conductors.

2. A sealed connector assembly as set forth in claim 1 wherein each said wire seal member sealingly engages said housing means at least after said camming member is moved to said second position.

3. A sealed connector assembly as set forth in claim 1 wherein each said wire seal member is adapted to receive a conductor therethrough having one of several preselected outer diameters.

4. A sealed connector assembly as set forth in claim 1 wherein each said wire seal member comprises an elastomeric sleeve-like body adapted to engage a cooperating stop surface of said housing means when urged axially forwardly by said camming member, and is further adapted to be engaged by a camming means of said camming member into sealing engagement with a said conductor extending therethrough.

5. A sealed connector assembly as set forth in claim 1 wherein said camming member has a transverse section with at least one bore therethrough such that said conductors are insertable therethrough.

6. A sealed connector assembly as set forth in claim 5 wherein said camming member has a bore associated with each said at least one terminal-receiving cavity and a respective said wire seal member associated therewith, and substantially axially aligned therewith such that each said respective conductor is insertable therethrough.

7. A sealed connector assembly as set forth in claim 6 wherein each said wire seal member has a forward conductor-engaging section and a connector-engaging section rearwardly therefrom.

8. A sealed connector assembly as set forth in claim 6 wherein each said bore includes a respective said cooperating camming means engageable with a said camming surface portion on a rearward section of an associated said wire seal member when said camming member is moved from said first position to said second position, to deform said wire seal member into sealing engagement with a respective said conductor therethrough.

9. A sealed connector assembly as set forth in claim 8 wherein said rigid camming member provides strain relief against axial and lateral forces on said conductor after being moved into said second position.

10. A sealed connector assembly as set forth in claim 8 wherein said camming surface portion on said rearward section of each said wire seal member is substantially annular and is engageable by a said associated cooperating camming means of said camming member.

11. A sealed connector assembly as set forth in claim 10 wherein said second position of said camming member is axially forward of said first position thereof.

12. A sealed connector assembly as set forth in claim 11 wherein said camming member is an integral part, said cooperating camming means thereof comprises a substantially annular camming surface of a respective bore and faces forwardly and inwardly with respect to said respective bore, said camming surface portion of said rearward section of a respective said wire seal member is substantially annular and faces rearwardly and outwardly and is associated with a respective said camming surface of said bore, said wire seal member is stopped from axially forward movement along said conductor, and said camming surface of said bore engages said camming surface portion of said wire seal member and deforms said wire seal at least radially inwardly into sealing engagement with said conductor when said camming member is moved axially forwardly from said first position to said second position.

13. A sealed connector assembly as set forth in claim 12 wherein each said wire seal member has a stop shoulder proximate a forward end thereof which engages a cooperating stop surface of said housing means to stop forward axial movement of said wire seal member when said camming member is moved from said first position to said second position.

14. A sealed connector assembly as set forth in claim 12 wherein one of said camming member and said housing means has a first latching projection and a second latching projection and the other of said camming member and said housing means has a cooperating latching slot such that said camming member is in said first position when said first latching projection is in said cooperating latching slot and is in said second position when said second latching projection is in said cooperating latching slot.

15. A sealed connector assembly as set forth in claim 14 wherein said camming member is keyed by keying means to said housing means.

16. A camming member for a sealed connector assembly having a housing member with a plurality of terminal-receiving cavities extending axially therethrough with a wire seal positioned in a rearward section of each said cavity to receive therethrough a terminated conductor associated with said wire seal to be secured in said cavity forwardly of said wire seal, comprising a rigid article including:

a transverse section having an axial profiled bore therethrough corresponding to each said terminal-receiving cavity of said housing member;

a collet section forwardly of said transverse section and mountable on a rearward end of said housing member such that each said axial bore is aligned with an associated housing cavity;

a substantially annular camming surface in each said profiled bore associated with a cooperating portion of a respective said wire seal positioned in the associated housing cavity; and slot means on said collet section cooperating with corresponding first and second projections on said housing member sequentially latchable within said slot means to position said camming member in a first position and in a second position spaced axially forwardly from said first position, whereby when said camming member is in said first position each said terminated conductor is insertable through a respective said axial bore through an associated said wire seal and into an associated terminal-receiving cavity and securable therein, and when said camming member is moved axially forwardly into said second position each said camming surface engages a said cooperating wire seal portion and cammingly urges it into sealing engagement with said conductor therewithin.

17. A method of sealing and strain relieving an electrical connector having conductors securable therein comprising the steps of:

selecting elastomeric wire seals for respective conductors having conductor-receiving apertures larger than the diameters of the respective conductors at least rearwardly from a forward end of said wire seals and being adapted to receive insertably thereinto and therethrough ends of respective conductors having terminals terminated thereon, and to initially loosely surround insulated portions of the conductors after insertion and substantially therealong;

positioning a forward section of a said wire seal in a rearward section of each of a plurality of terminal-receiving passageways of a connector against respective stop means of said passageways such that at least a rearward section of each said wire seal extends rearwardly from a respective one of said passageways;

securing a rigid camming member in a first position to a rearward end of said connector, said camming member having bores through a transverse section thereof corresponding with said passageways and said wire seals therein and exposing rearward ends of said wire seals, whereby said connector, said camming member and said wire seals comprise a complete preassembled connector assembly prior to insertion of terminated conductors thereinto;

inserting said terminated conductors through respective said bores and wire seals, and into said passageways wherein terminals on said conductors are secured; and urging said camming member axially forwardly to a second position and into camming engagement with said rearward sections of said wire seals deformingly urging them radially inwardly engagingly and sealingly against respective said conductors extending therethrough, whereby sealing engagement and strain relieving engagement are obtained at least between each said wire seal and a respective said conductor, and between each said wire seal and said camming member.

* * * * *